US006171082B1

(12) United States Patent
Hankner et al.

(10) Patent No.: US 6,171,082 B1
(45) Date of Patent: Jan. 9, 2001

(54) PERISTALTIC PUMPING MECHANISM

(75) Inventors: Doulas O. Hankner, St. Paul; Reginald D. Robinson, Brooklyn Park; Dennis D. Elsberry, New Hope, all of MN (US)

(73) Assignee: Medtronic, Inc., Minneapolis, MN (US)

( * ) Notice: Under 35 U.S.C. 154(b), the term of this patent shall be extended for 0 days.

(21) Appl. No.: 08/787,067

(22) Filed: Jan. 22, 1997

(51) Int. Cl.[7] ..... F04B 43/08
(52) U.S. Cl. ..... 417/477.12; 604/153; 138/177
(58) Field of Search ..... 417/477.12; 609/153; 138/177, 143, DIG. 11

(56) References Cited

U.S. PATENT DOCUMENTS

| | | | | |
|---|---|---|---|---|
| 4,482,347 | | 11/1984 | Borsanyi | 604/153 |
| 4,540,350 | * | 9/1985 | Streicher | 417/475 |
| 4,576,556 | | 3/1986 | Thompson | 417/477 |
| 4,692,147 | | 9/1987 | Duggan | 604/93 |
| 4,909,710 | | 3/1990 | Kaplan et al. | 417/53 |
| 5,217,355 | | 6/1993 | Hyman et al. | 417/474 |
| 5,281,112 | * | 1/1994 | Montoya et al. . | |

* cited by examiner

*Primary Examiner*—Charles G. Freay
(74) *Attorney, Agent, or Firm*—Eric R. Waldkoetter; Curtis D. Kinghorn; Harold R. Patton

(57) ABSTRACT

A peristaltic pumping mechanism is provided with a non-permeable peristaltic circuit comprising two strips of thin metal laser bonded at their edges to form a tube. In one embodiment, the non-permeable tubing takes the form of a continuous loop having input and output ports. In another embodiment, the tubing is open and generally U-shaped. In still another embodiment, a dual-tube circuit is provided, wherein a central, metal tube is disposed within an outer elastomeric tube having an inner diameter larger than the outer dimension of the metal tube. The elastomeric tube supports the metal tube only at the ends of the circuit, enabling the metal tube to "float" within the elastomeric tube.

34 Claims, 5 Drawing Sheets

PERISTALTIC PUMPING MECHANISM

FIELD OF THE INVENTION

This invention relates generally to the field of medical devices, and more particularly relates to tubes for peristaltic pumping mechanisms.

BACKGROUND OF THE INVENTION

In the medical field, there are numerous applications for pumping mechanisms, that generally operate to pump liquid and/or compressible gas mixtures by repeatedly squeezing a flexible tube to push the pumped substance therethrough. Two examples of such pumping mechanisms are "roller pump" peristaltic pumps and linear peristaltic pumps.

Typically, "roller pumps" employ a stator having a bearing surface against which one or more hoses is compressed by a rotating rotor, the rotor engaging the hoses with two or more rollers. On rotation of the rotor, the fluid in the hose or hoses is transported in the direction of the rotor's rotation. Alternatively, the fluid can be presented to the pump under pressure, such that rotation of the rotor causes the pump to serve as a measuring valve. In either instance, knowledge as to the inner diameter of the hose or hoses and the rotational speed of the rotor provides a knowledge of the amount of fluid passed through the hose or hoses, which amount can be regulated by regulating the speed of the rotor.

Examples of prior art "roller pump" peristaltic pumps, used for drug administration devices, are proposed in U.S. Pat. No. 4,576,556 to Thompson, entitled "Roller Pump," and in U.S. Pat. No. 4,692,147 to Duggan, entitled "Drug Administration Device." The Thompson '556 and Duggan '147 patents are commonly assigned to the assignee of the present invention and are hereby incorporated by reference herein in their respective entireties. It has been demonstrated that peristaltic pumps such as those described in the Thompson '556 and Duggan '147 patents provide a highly reliable mechanism for inclusion in a totally body-implantable drug infusion pump including a control system, power source, fluid reservoir, and refilling mechanism.

Linear peristaltic pumps typically have a series of fingers or cams that contact and compress a flexible tube in a sequential linear fashion so that fluid in the tube is pushed along ahead of the closing fingers or cams. Examples of linear peristaltic pumps include U.S. Pat. No. 4,482,347 for "Peristaltic Fluid-Pumping Apparatus" issued to Alexander S. Borsanyi on Nov. 13, 1984, U.S. Pat. No. 4,909,710 for "Linear Peristaltic Pump" issued to David E. Kaplan, David Burkett and Laurence Warden on Mar. 20, 1990 and U.S. Pat. No. 5,217,355 for "Two-Cycle Peristaltic Pump with Occlusion Detector" issued to Oscar E. Hyman, Ahmadmahir M. Moubayd and Larry L. Wilson on Jun. 8, 1993

A desirable characteristic of either type of peristaltic pump is the fact that the substance being pumped does not come into contact with any component of the pump other than the inside of the flexible tubing; thus, sterility of the substance is preserved. Peristaltic pumps are also known to be volumetrically accurate and to have a high degree of constancy and uniformity of flow. In addition, the positive displacement nature of peristaltic pumping mechanisms render them capable of pumping fluid/compressible gas mixtures and fluids with varying viscosities. Peristaltic pumps have proven to be highly reliable for application with, among others, aqueous drug formulations.

Prior art peristaltic pumping mechanisms for drug delivery or infusion typically use an elastomeric tubing circuit as the conduit for moving the drug through the pumping circuit by displacement during tubing compression by peristaltic pumping rollers. Potential disadvantages of prior art designs using elastomeric tubing include the inability to prevent permeation of water vapor and drug components from the drug formulation through the tubing wall, potentially resulting in adverse corrosive effects on the pump motor and gear drive train assembly.

Permeation of water vapor and drug components through the peristaltic tubing wall can also lead to reduced product longevity due to the increased mechanical friction or compromised electrical isolation with increased parasitic electrical resistance in excess of motor output capacity. Moreover, certain drug formulations may require the use of lipophilic agents or organic solvents due to low aqueous solubility. Such agents or solvents may not be compatible with the elastomeric peristaltic tubing, and elastomer degradation or swelling may arise, causing compromised product life.

Parasitic mechanical friction produced by passing the roller over a drug-swollen elastomeric surface creates an additional energy requirement, which can further limit the pump's functional longevity.

In the context of a fully implantable device, exemplified by the SynchroMed® drug infusion system commercially available from Medtronic, Inc., Minneapolis, Minn., the foregoing and other considerations are of particular concern. If the elastomeric pump circuit does not establish a hermetic barrier to water vapor permeation, the reduction gear drive mechanism, motor coil, and electronic circuitry will be exposed to a humidified environment. With prolonged exposure to such a humidified environment, gear lubricant breakdown can occur, leading to increased gear wear and friction to moving parts. Secondarily, certain elastomeric tubing, such as silicone polymers and the like, are prone to absorption of various components of the therapeutic formations being pumped. This absorption results in elastomeric swell which manifests itself in either reduced life due to friction or immediate pump stall due to frictional forces in excess of pump driving force.

SUMMARY OF THE INVENTION

In view of the foregoing considerations, the present invention is directed to a method and apparatus for drug infusion.

In particular, the present invention overcomes potential disadvantages of prior art peristaltic pumping systems by providing a peristaltic pumping circuit with a formed, non-permeable compressible metal tube rather than a permeable elastomeric tube.

The present state of metallurgical technology is such that extremely thin-walled metal sheets can be made. Such sheets can be elliptical in shape and capable of mirrored positioning for fusion by laser welding into a fused tube or continuous toroidal shape. Laser welding has also been shown to be suitable for fusing reservoir components of comparable thickness.

In accordance with one feature of the present invention, therefore, a peristaltic pumping mechanism is provided with peristaltic tubing comprising, preferably, two strips of thin metal sheets, providing a non-permeable peristaltic circuit for the pumping mechanism.

In a variant of this embodiment, the peristaltic tubing is made of two strips of any flexible non-permeable material. In a further variant, the peristaltic tubing is made of a single sheet of flexible non-permeable material that is folded over on itself bringing opposite edges into contact. These opposite edges are sealed to produce a tube.

In one embodiment of the invention, the non-permeable peristaltic circuit is in the form of a continuous loop having input and output ports extending generally radially therefrom. In another embodiment of the invention, the peristaltic circuit is open and generally U-shaped.

In still another embodiment of the invention, a dual-tube peristaltic circuit is provided, with an inner, non-permeable (preferably metallic) tube for conducting the substance to be pumped, and a concentric, outer (preferably elastomeric) tube. The outer tube preferably has an inner diameter larger than the outer dimension of the inner metallic tube and supports the metallic tube only at each end, such that the inner tube essentially "floats" within the elastomeric tube. This embodiment takes advantage of the non-permeability of the inner tube, while the outer tube provides protection for the inner tube and serves as a shim or offsetting element for the pump rotor.

BRIEF DESCRIPTION OF THE DRAWINGS

The foregoing and other aspects of the present invention may perhaps be best appreciated with reference to a detailed description of a specific embodiment of the invention, when read in conjunction with the accompanying drawings, wherein.

DETAILED DESCRIPTION OF SPECIFIC EMBODIMENTS OF THE INVENTION

A detailed description of embodiments of the invention is presented. Throughout this disclosure unless stated otherwise, like elements, wherever referred to, are referred by like reference numbers.

Figure 1:
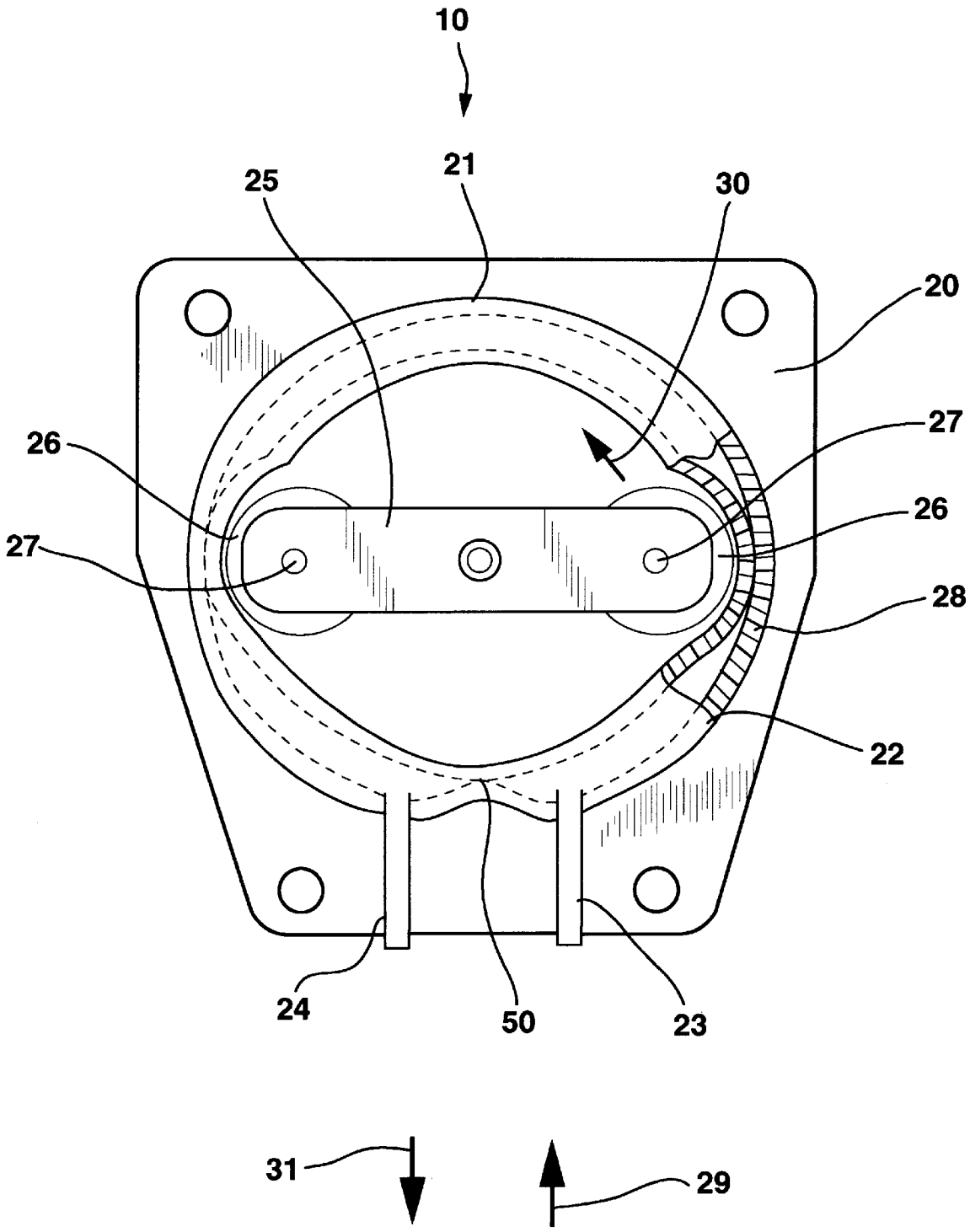
FIG. 1 illustrates diagrammatically a peristaltic pumping mechanism in accordance with one embodiment of the invention.

FIG. 1 illustrates a peristaltic or roller pump 10 in accordance with one embodiment of the present invention. Pump 10, like that disclosed in the above-referenced Thompson '556 patent is adapted to be incorporated into a body-implantable drug infusion system. Pump 10 includes a stator 20 having a generally cylindrical bearing surface 21. A hose 22 is placed in stator 20 in contact with bearing surface. Hose 22 comprises a continuous loop of tubing with an input port 23 and an output port 24. Hose 22 overlies the arcuate stator bearing surface 21.

A rotor 25 rotates around a central rotor axis 35. A plurality of rollers 26 (two are shown in FIG. 1) are attached at the periphery of rotor 25 and rotate about a central roller axis 27, in a known manner, to compress hose 22 against the stator bearing surface 21. Preferably, the compression is complete, as shown at cutaway 28, to eliminate leakage. As would be known to those of ordinary skill in the art, rollers 26 can be carried by levers or be spring-biased to regulate the amount of compressing force applied to hose 22, the particular design of rotor 25 and rollers 26 not being a critical aspect of the present invention. The key to the operation of rotor 25 and rollers 26 being the pushing of fluid through the hose 22.

A fluid supply enters hose 22 through inlet port 23 in the direction indicated by arrow 29 in FIG. 1 as rotor 25 rotates in the direction indicated by arrow 30. Fluid in hose 22 moves through tube 22 to exit through outlet 24 in the direction indicated by arrow 31.

As noted in the Summary of the Invention above, the present invention is directed primarily to the peristaltic pumping circuit itself. In particular, the present invention is directed to the fabrication of peristaltic tubing from thin sheets of metal. It is believed that such tubing in accordance with the present invention has desirable characteristics in the context of peristaltic pumping mechanisms.

Figure 2:
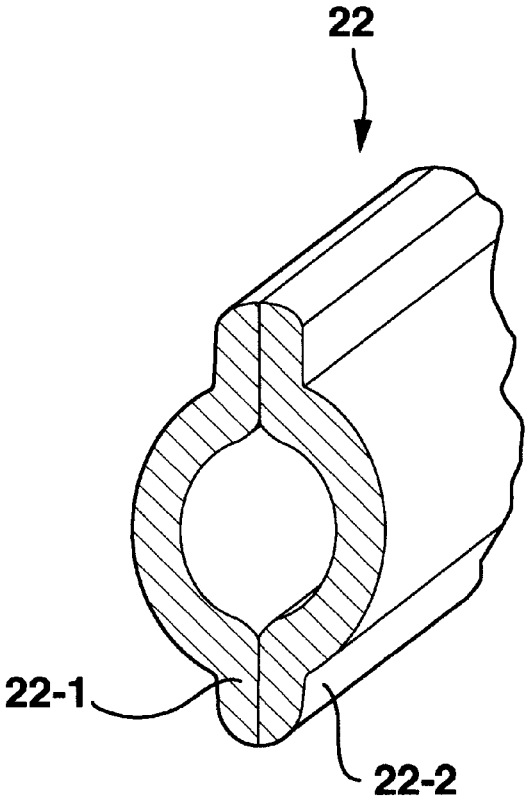
FIG. 2 is a perspective view of the peristaltic pump tubing from the pump of FIG. 1, shown in FIG. 2 in an uncompressed condition.
Figure 3:
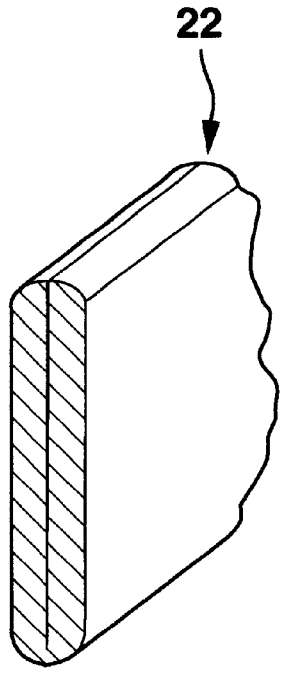
FIG. 3 is a perspective view of the peristaltic pump tubing from FIG. 2 shown in a compressed condition.

FIG. 2 shows a perspective view of a portion of peristaltic tubing 22 in accordance with a presently preferred embodiment of the invention. As shown in FIG. 2, tubing 22 preferably comprises two halves 22-1 and 22-2 which are, in the preferred embodiment, elongate metal strips that have been laser welded or otherwise joined at their upper and lower edges to form a fused tube or continuous generally toroidal shape. In the presently preferred embodiment, metal tubing components 22-1 and 22-2 are Titanium grades I or II or an alloy, such as Titanium 6 Aluminum 4 Vanadium, and having a thickness ranging between approximately 0.051– to 0.076 millimeters. As a result of the thinness of tubing components 22-1 and 22-1, tubing 22 is capable of being compressed from its open condition, shown in FIG. 2, to a closed condition, shown in FIG. 3.

In an alternate embodiment, tubing 22 is formed of a single metal sheet having opposing edges folded toward each other and fused to form a tube.

Figure 4:
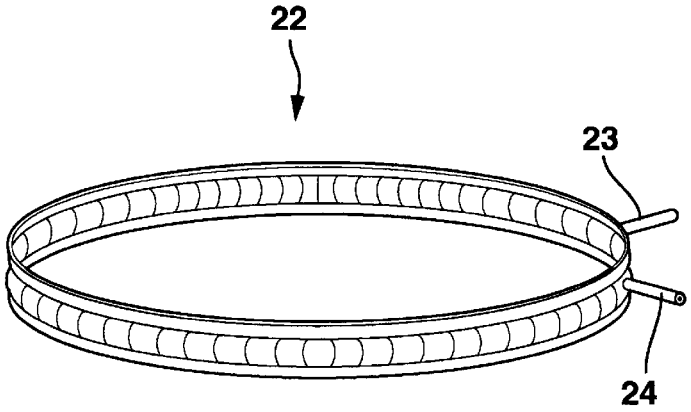
FIG. 4 is a perspective view of the peristaltic pump tubing from FIGS. 2 and 3.
Figure 5:
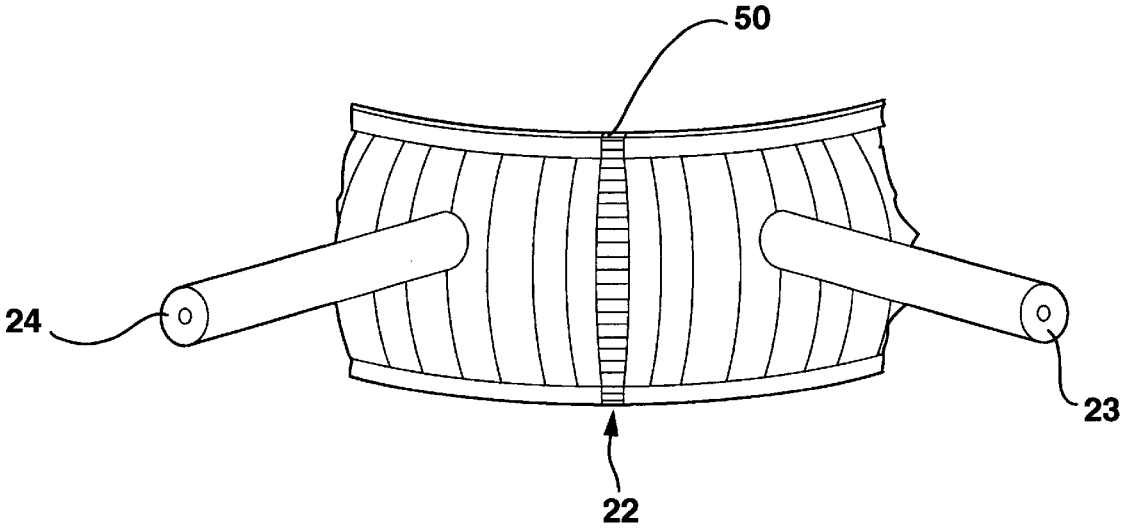
FIG. 5 is a perspective view of a portion of the pump tubing from FIGS. 2–4, showing input and output ports thereof.

FIG. 4 shows peristaltic tubing 22 in its entirety, and also shows inlet port 23 and outlet port 24. In one embodiment, tubing 22 is a continuous loop, with inlet port 23 and outlet port 24 joined but fluidly separated by a laser fused seam 50. An enlarged view of this detail is shown in FIG. 5. According to this embodiment, inlet port 23 and outlet port 24 may be joined in approximately side by side relation or separated by a separation distance of many diameters of tubing 22.

From the standpoint of manufacturability, the embodiment of the invention described herein with reference to FIGS. 1–5—having a continuous generally toroidal peristaltic circuit—is believed to be preferable. It is contemplated, however, that as an alternative embodiment a generally U-shaped circuit could also be fabricated.

Materials such as Titanium and the alloys noted above are known to have excellent compatibility with current drug formulations approved or currently at clinical investigational status. These materials have demonstrated suitable fatigue resistance for compression cycling over several hundred thousand cycles. Moreover, such materials are capable of being processed with various elastomeric coatings applied to the inner lumen of the peristaltic circuit to further enhance sealing characteristics during pump circuit compression.

As alternate embodiments to the embodiments above using two or a single sheet to form tubing 22, tubing 22 may be made of any flexible non-permeable material. Examples of such material include, but are not limited to ceramics or polymers. In particular, a polymeric sheet may be advantageously used to make tubing 22. An example of a particular polymer that has been found to be effective is polyvinylidene chloride which is sold as Sarang) brand plastic sheeting. Examples of other polymers that may be advantageously used are polyester films such as polyethylene terephthalate sold as Mylar®.

Figure 6:
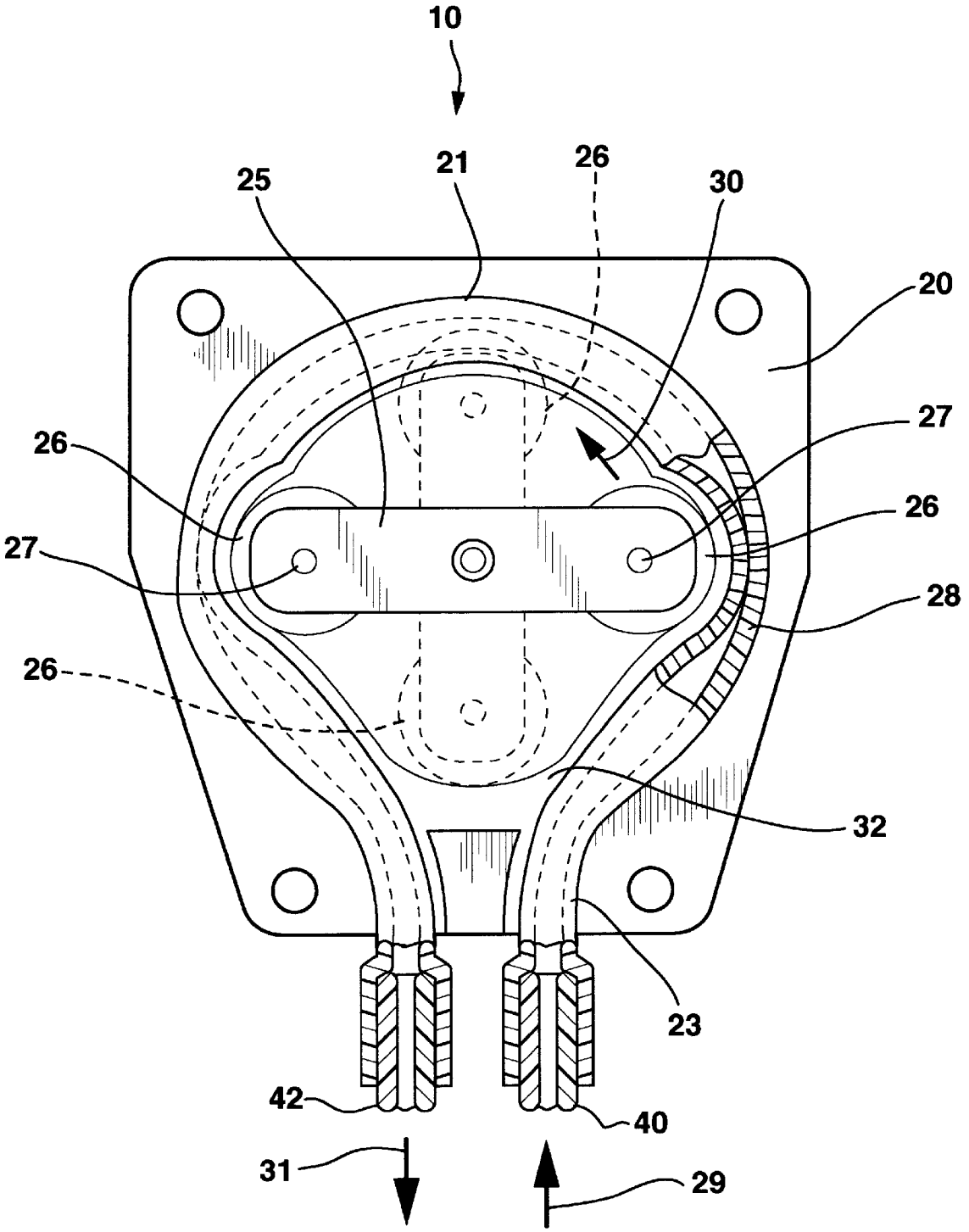
FIG. 6 illustrates diagrammatically a peristaltic pumping mechanism in accordance with an alternate embodiment of the invention.

An example of such an alternate embodiment is shown in FIG. 6. Connectors 40 and 42 fluidly connect a tube 22 to a source of fluid and to a delivery system for fluid, respectively. Connectors 40, 42 are preferably laser-welded to tubing 22.

The embodiment of FIG. 6 includes an offset or shim member 32 supported by a backing member 33, in accordance with the teachings of the above-referenced Thompson '556 patent. Shim member 32 provides a counterbalancing or offsetting force on the lower-most of the rollers 26 shown in phantom in FIG. 6, to minimize leakage of the pump and provide a more uniform torque requirement on the drive system. The function of shim member 32 is described in further detail in the Thompson '556 patent, but is not believed to be critical to the practice of the present invention.

In all other respects, the embodiment shown in FIG. 6 and described immediately above is identical to the preferred embodiment shown in FIGS. 1–5 and described above.

Figure 7:
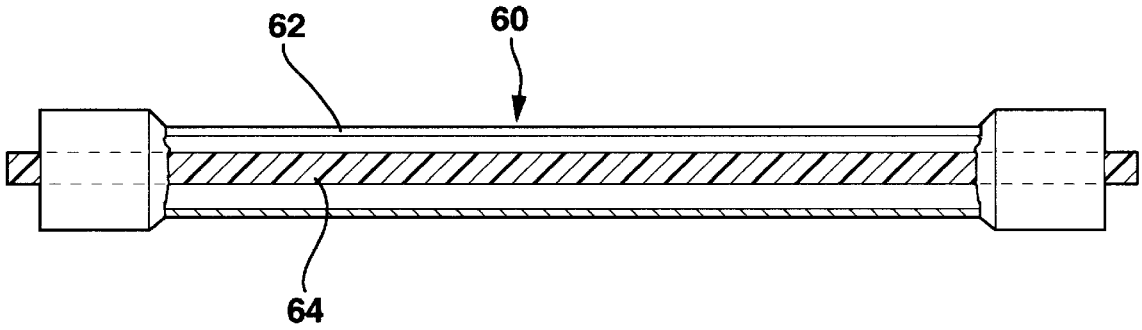
FIG. 7 is a side cross-sectional view of a peristaltic pump tubing in accordance with still another embodiment of the invention.
Figure 8:
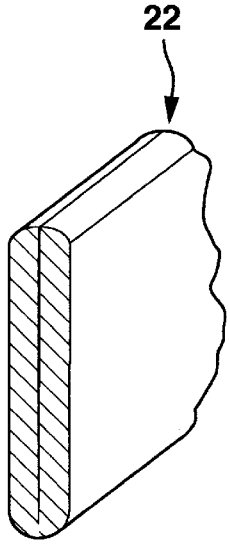
FIG. 8 is a perpective view of the peristaltic pump tubing made of a single sheet.

Still another alternative embodiment of the invention involves providing a dual-tube peristaltic circuit 60, as shown in FIG. 7. In this embodiment, peristaltic circuit 60 includes metal tubing 62 substantially identical to tubing 22 in the embodiment of FIGS. 1–5, and outer elastomeric tubing 64, concentric with metal tubing 62. As shown in FIG. 7, metal tubing 62 is allowed to "float" within outer elastomeric tubing 64 for substantially all of the length of circuit 60; that is, the inner diameter of elastomeric tubing 64 is larger than the outer dimensions of inner metal tubing 62, and metal tubing 62 is supported by elastomeric tubing only at each end of peristaltic circuit 60.

The embodiment of FIG. 7 takes advantage of the non-permeable quality of metal tubing 62 and allows elastomeric tubing 64 to serve as a shim or offset member generally in accordance with the teachings of the Thompson '556 patent.

In the embodiments of FIGS. 6 and 7, the permeable and non-permeable materials preferably used may be replaced with other materials having the desired flexibility and permeability characteristics. Once again, as will be clear to those skilled in the art, examples of such material may include, but are not limited to ceramics or polymers.

In particular, a polymeric sheet may be adventageously used to make tubing 22. An example of a particular polymer that has been found to be effective is polyvinylidene chloride which is sold as Saran brand plastic sheeting. Examples of other polymers that may be advantageously used are polyester films such as polyethylene terephthalate sold as Mylar®.

From the foregoing detailed description of specific embodiments of the invention, it should be apparent that a peristaltic pumping mechanism has been disclosed, and in particular, that a peristaltic pumping circuit comprising thin metallic tubing has been disclosed. Although specific features of the various embodiments have been set forth herein in some detail, it is to be understood that this has been done merely for the purposes of describing various aspects of the invention, and is not intended to be limiting with respect to the scope of the invention. It is believed that various substitutions, alterations, and/or modifications, including but not limited to those design options and variations specifically discussed herein, may be made to the various embodiments disclosed without departing from the spirit and scope of the invention as defined in the appended claims.

For example, and as noted above, while a rotor type embodiment of the invention has been described herein, it is contemplated that the present invention can be adapted to be practiced in connection with a linear peristaltic pump. In this embodiment, the tubing 22 or circuit 60 is placed in the linear pump so that the "fingers" or cams of the pump contact the tubing 22 or tubing 64 to cause fluid to flow through the tubing 22.

What is claimed is:

1. A peristaltic tube comprising: a first and a second sheet of a flexible, non-permeable material, each sheet having opposed sides, the opposed sides of the first sheet joined and sealed to the opposed sides of the second sheet so that a tube is formed between the first and second sheet, the tube having a first end and a second end, with an inlet port at the first end of the tube and an outlet port at the second end of the tube wherein the inlet port and the outlet port are joined but fluidity separated at a shortest connecting point between the inlet port and the outlet port.

2. The tube of claim 1 wherein the tube is substantially toroidal.

3. The tube of claim 1 wherein the inlet port and the outlet port are joined but fluidly separated by a laser fused seam.

4. The tube of claim 1 wherein the inlet port and the outlet port are joined in approximately a side by side relation.

5. The tube of claim 1 wherein the inlet port and the outlet port, though joined, are separated by at least the width of the tube.

6. The tube of claim 1 wherein the first and second sheets are joined and sealed by welding.

7. The tube of claim 6 wherein the first and second sheets are joined and sealed by laser welding.

8. The tube of claim 1 further comprising a shim.

9. The tube of claim 8 further comprising a backing member wherein the backing member supports the shim.

10. A peristaltic tube comprising:

a sheet of a flexible, non-permeable material, the sheet having opposed sides, the opposed sides of the sheet joined and sealed so that a tube is formed having a first end and a second end.

11. The tube of claim 10 wherein the tube is substantially toroidal.

12. The tube of claim 10 further comprising an inlet port at the first end of the tube and an outlet port at the second end of the tube.

13. The tube of claim 12 wherein the inlet port and the outlet port are joined but fluidly separated at a shortest connecting point between the inlet port and the outlet port.

14. The tube of claim 13 wherein the inlet port and the outlet port are joined but fluidly separated by a laser fused seam.

15. The tube of claim 13 wherein the inlet port and the outlet port are joined in approximately a side by side relation.

16. The tube of claim 13 wherein the inlet port and the outlet port, though joined, are separated by a least the width of the tube.

17. The tube of claim 10 wherein the sheet is joined and sealed by welding.

18. The tube of claim 17 wherein the sheet is joined and sealed by laser welding.

19. The tube of claim 10 wherein the flexible, non-permeable material is metal.

20. The tube of claim 19 wherein the metal is chosen from the group consisting of Titanium, Aluminum and Vanadium.

21. The tube of claim 19 wherein the metal has a thickness ranging between approximately 0.051 to 0.076 millimeters.

22. The tube of claim 10 further comprising a shim.

23. The tube of claim 22 further comprising a backing member wherein the backing member supports the shim.

24. A peristaltic tube made according to the steps of: providing two sheets of a flexible non-permeable material, each of the sheets having opposed edges; joining their respective opposed edges to form a tube; attaching an inlet port at the first end of the tube and an outlet port at the second end of the tube; and, joining the inlet port and the outlet port so that the inlet port and the outlet port are fluidity separated at a shortest connecting point between the inlet port and the outlet port.

25. The tube of claim 24 further comprising the step of forming the tube in substantially a toroidal configuration.

26. The tube of claim 24 wherein the step of joining the inlet port and the outlet port includes the step of joining the inlet port and the outlet port a laser fused seam.

27. The tube of claim 24 wherein the step of joining the inlet port and the outlet port includes the step of joining the inlet port and the outlet port in approximately a side by side relation.

28. The tube of claim 24 wherein the step of joining the inlet port and the outlet port includes the step of joining the inlet port and the outlet port by a least the width of the tube.

29. The tube of claim 24 wherein the step of joining respective opposed edges to form a tube includes the step of joining respective opposed edges by welding.

30. The tube of claim 29 wherein the step of joining respective opposed edges to form a tube includes the step of joining respective opposed edges by laser welding.

31. The tube of claim 24 wherein the step of providing two sheets of a flexible non-permeable material includes the step of providing two sheets of a flexible non-permeable polymer material.

32. The tube of claim 31 wherein the step of providing two sheets of a flexible non-permeable material includes the step of providing two sheets of a flexible non-permeable polymer material having a thickness ranging between approximately 0.051 to 0.076 millimeters.

33. The tube of claim 31 wherein the step of providing two sheets of a flexible non-permeable polymer material includes the step of providing two sheets of a flexible non-permeable polyethylene terephthalate.

34. The tube of claim 31 wherein the step of providing two sheets of a flexible non-permeable polymer material includes the step of providing two sheets of a flexible non-permeable polyester film.

* * * * *